US005515799A

United States Patent [19]

Heptner

[11] Patent Number: 5,515,799

[45] Date of Patent: May 14, 1996

[54] METHOD OF MAKING PARTIALLY FITTED TOP SHEET

[76] Inventor: Patricia Heptner, 307 Maple Ave., Johnstown, Pa. 15901

[21] Appl. No.: 515,524

[22] Filed: Aug. 15, 1995

Related U.S. Application Data

[62] Division of Ser. No. 259,541, Jun. 14, 1994, Pat. No. 5,465,440.

[51] Int. Cl.[6] ..... D05B 1/00; D05B 97/00

[52] U.S. Cl. ..... 112/475.08; 5/495

[58] Field of Search ..... 112/475.08; 5/497, 5/495, 485, 496, 498, 482, 499, 500, 502

[56] References Cited

U.S. PATENT DOCUMENTS

| | | | |
|---|---|---|---|
| 2,695,414 | 4/1954 | Ford et al. | 5/485 |
| 4,035,854 | 7/1977 | Pardee | 5/497 |
| 4,682,555 | 7/1987 | Bierbaum et al. | 112/475.08 |
| 4,912,790 | 4/1990 | MacDonald | 5/497 |
| 5,375,274 | 12/1994 | Cuneo | 5/497 |

*Primary Examiner*—Alexander Grosz
*Attorney, Agent, or Firm*—James Ray & Associates

[57] ABSTRACT

A method of making a partially fitted top sheet for a bed mattress, having a predetermined thickness and a rectangular upper surface with a predetermined width and predetermined length, from a rectangular flat bed sheet. Such method includes cutting away at least one edge of such rectangular flat bed sheet and finishing the cut edge to form a rectangular flat bed sheet having a width approximately equal to the width of such bed mattress plus twice the thickness of such bed mattress and determining which of two adjacent corners will be further formed into bottom corners of such bed sheet. Then, sewing each of such bottom corners of the rectangular bed sheet as necessary to provide a pair of rectangular side portions joined to a rectangular bottom portion to form a three-sided shirt capable of extending perpendicularly away from a remaining portion of such flat bed sheet. Such three-sided skirt having a width approximately equal to the thickness of such bed mattress.

7 Claims, 2 Drawing Sheets

METHOD OF MAKING PARTIALLY FITTED TOP SHEET

This application is a divisional application of application Ser. No. 08/259,541, filed Jun. 14, 1994, now U.S. Pat. No. 5,465,440, issued Nov. 14, 1995.

FIELD OF THE INVENTION

This invention relates generally to a top bed sheet for a sleeping bed mattress and more particularly to a new and unique partially fitted top sheet for a mattress, including a preferred method of fitting the top sheet onto a mattress, and relates also to a method of making such a partially fitted top sheet from a conventional unfitted, flat bed sheet.

BACKGROUND OF THE INVENTION

Conventional unfitted, flat bed sheets are well known to any homemaker which, to be fitted onto a bed mattress, are spread flat over the upper surface of the bed mattress and centered to the degree desired, and at least certain edges thereof are normally tucked under the mattress between the mattress and box springs, to keep the sheet or sheets neat and in place. While the bottom sheet is normally spread flat over the mattress and centered so that a reasonably equal edge thereof is available around the peripheral sides of the mattress to be tucked between the mattress and box springs so that such bottom sheet not only remains in place but also covers all visible surfaces of the mattress, the usual practice for applying a top sheet is normally different. The top sheet is not normally centered over the entire upper surface of the bed mattress, but rather is pulled downwardly to a modest extent so that an edge of the top sheet is exposed across the top of the mattress for purposes of facilitating the ability of getting into such a bed. While the bottom of such a top sheet is normally tucked between the mattress and box springs, the sides are not normally tucked between the mattress and box springs so that when going to bed, one can pull back the top sheet at the exposed upper edge and readily slip himself or herself under the top sheet. While some homemakers may choose to tuck-in the sides of the top bed sheet for purposes of hiding such sides from view, such a tucked-in side must, nevertheless, be pulled out, at least partially, in order to gain access to the bed as described above.

Fitted bottom sheets are also well know to practically any homemaker in which a pocket is sewn into each corner of the sheet so that such a fitted bottom sheet can be stretched tight over the bed mattress and the stitched pockets then pulled down over the mattress corners. With the mattress corners fitted into sown pockets, the fitted bottom sheet will be held tightly in place, stretched tight over the top and side surfaces of the bed mattress. Because one must be able to easily get into and out of bed, as noted above, however, fitted top sheets have not been proposed to any extent. If a fitted top bed sheet were stretched tight, as in the case of a fitted bottom bed sheet, the results would be rather uncomfortable to the sleeper, and there would be little room to accommodate the sleeper, and particularly his or her feet would be especially cramped and confined. Accordingly, even when using a fitted bottom sheet, conventional practice has been to use a conventional flat bed sheet as the top sheet. Therefore, even though the use of a fitted bottom sheet will eliminate any need to attend to such a bottom sheet when making the bed after use, the continued use of a flat bed sheet as the top sheet still requires that considerable attention be directed thereto in making the bed after use, to assure that it is properly repositioned, and the sides tucked from view if necessary. In the case of beds positioned against a wall, and especially bunk beds, the chore of making a bed after use is still rather complicated by the fact the the bed must normally be moved away from the wall to gain access to the back side for purposes of attending at least to the top sheet, as noted above.

SUMMARY OF THE INVENTION

This invention is predicated upon a new and unique partially fitted top bed sheet which can be easily put onto a conventional bed mattress over a fitted or non-fitted bottom sheet which will not only stay neatly in place, but will save time in making-up the bed and making the bed after its use. Although the partially fitted bed top sheet of this invention is designed to fit neatly and rather snugly, it allows ample foot and body room due to diagonally angled side overhangs that provides as much foot room as a traditionally made bed with hospital corner, so that it is not stretched taut over the sleeper's body or feet. In addition the partially fitted top bed sheet of this invention eliminates unnecessary overhang, making it ideal for use with day beds, bunk beds, loft beds, captain's beds with drawers or shelving and even platform beds, such as race car beds and the like. In such applications, the inventive partially fitted bed sheet makes it ideal for use on beds having one side positioned against a wall in that the bed need not be pulled away from the wall to be made for purposes of tucking-in an excessive overhang. As may be further apparent, the partially fitted bed sheet of this invention is further ideal for use in combination with a comforter, quilt, ruffle or the like, where a conventional top sheet would hang-out below the comforter, quilt, ruffle or the like, and have to be tucked-in to hide any unsightly exposed mattress sides.

In essence the partially fitted top sheet of this invention comprises a single piece of fabric shaped much like a shoe-box lid with one end cut away. Specifically, the one piece of fabric includes a rectangular top surface portion, the dimensions of which are adapted to fit flatly over the rectangular upper surface of the bed mattress; a pair of rectangular side portions, one each extending from opposite side edges of the rectangular top surface portion and adapted to hang downwardly therefrom, and having a width sufficient to overhang at least a major portion of the side surfaces of the bed mattress; and a rectangular bottom portion extending from the bottom edge of the rectangular top surface portion transversely between the pair of rectangular side portions as though intended to overhang the bottom side surface of the bed mattress. The edge of the rectangular bottom portion is sewn to each adjacent edge of the rectangular side portions to finish the three-sided "shoe-box lid" configuration, so that the rectangular side portions and the rectangular bottom portion form a continuous, three-sided overhanging skirt extending perpendicularly from the rectangular top surface portion along each of the side edges and bottom edge of the bed mattress. In addition to the sheet fabric, at least one length of elastic material is preferably secured along at least a portion of the rectangular bottom portion extending transversely between the pair of side portions, which is attached while in an outstretched condition for the purpose of causing the ends of the rectangular side portions, adjacent to the bottom portion, to be drawn towards each other when fitted onto a bed mattress.

While the partially fitted top sheet of this invention can be made from any fabric material, it can easily be made from a conventional unfitted, flat bed sheet so that one can have such a partially fitted top sheet in a set matching a bottom sheet.

To make the partially fitted top sheet from a conventional, unfitted, flat bed sheet and having the advantages taught herein, it is first preferable to cut away at least one edge of the rectangular flat bed sheet and finishing the cut edge to form a rectangular flat bed sheet having a width approximately equal to the width of the bed mattress plus approximately twice the thickness. Then after determining which of two adjacent corners will be further cut to form bottom corners of the bed sheet, generally square portions must be cut away from each of the bottom corners of the rectangular bed sheet to leave a pair of cut edges at a right angle to each other at each of the bottom corners. Accordingly, a pair of rectangular side portions, as well as a rectangular bottom portion are formed extending from each side and the bottom of the rectangular top portion. The square cut away portions should ideally have a side dimension approximately equal to the thickness of the bed mattress, and the two cut edges at each corner joined together so that the two rectangular side portions and a rectangular bottom portion form a continuous skirt capable of extending perpendicularly away from a remaining portion of the flat bed sheet; i.e., the rectangular top surface portion, to form the partial "shoe-box lid" configuration, as described above. Lastly, at least one length of elastic material is preferably secured along at least a portion of the length of the rectangular bottom portion sufficient to cause the pair of rectangular side portions to be drawn together adjacent to the rectangular bottom portion when the sheet is fitted onto a bed mattress.

While the above described partially fitted bed sheet can be applied onto a bed mattress with the perpendicular side and bottom portions extending downwardly over the three side edges of the mattress in much the same way as one would apply a shoe-box lid onto a shoe-box, the real advantages of the inventive partially fitted top bed sheet is derived by placing the rectangular bottom portion of the sheet completely under the lower portion of the mattress. In that way, the partially fitted top sheet is not only held neatly in place on the bed mattress, but diagonally angled side overhangs are naturally formed at the bottom corners, which will cause neatly appearing side overhangs to be formed which normally need no further attention, and will provide ample foot and body room.

OBJECTS OF THE INVENTION

The primary object of this invention is to provide a partially fitted top bed sheet for a bed mattress.

Another primary object of this invention is to provide a unique and novel partially fitted top bed sheet for a bed mattress which will save time in making-up the bed and in making the bed after use.

A further object of this invention is to provide a unique and novel partially fitted top bed sheet for a bed mattress which will permit a child to more easily make the bed neatly after use.

Still another object of this invention if to provide a unique and novel partially fitted top bed sheet for a bed mattress which minimizes excessive overhang making it ideal for use with day beds, bunk beds, loft beds, captain's beds with drawers or shelving and even platform beds, such as race car beds and the like.

An additional object of this invention is to provide a unique and novel partially fitted top bed sheet for a bed mattress in which the bottom portion can be tucked under the mattress to hold the bed sheet in place and to additionally cause the natural formation of diagonally angled side overhangs at the bottom corners.

An even further object of this invention is to provide a unique and novel partially fitted top bed sheet for a bed mattress that can be fitted onto a bed mattress and yet provide ample foot room and comfort to the sleeper.

These and other objects and advantages of this invention will become apparent from a better understanding of the following detailed description of the invention, especially when considered in conjunction with the following described drawings.

DESCRIPTION OF THE PREFERRED EMBODIMENTS OF THE INVENTION

Figure 1:
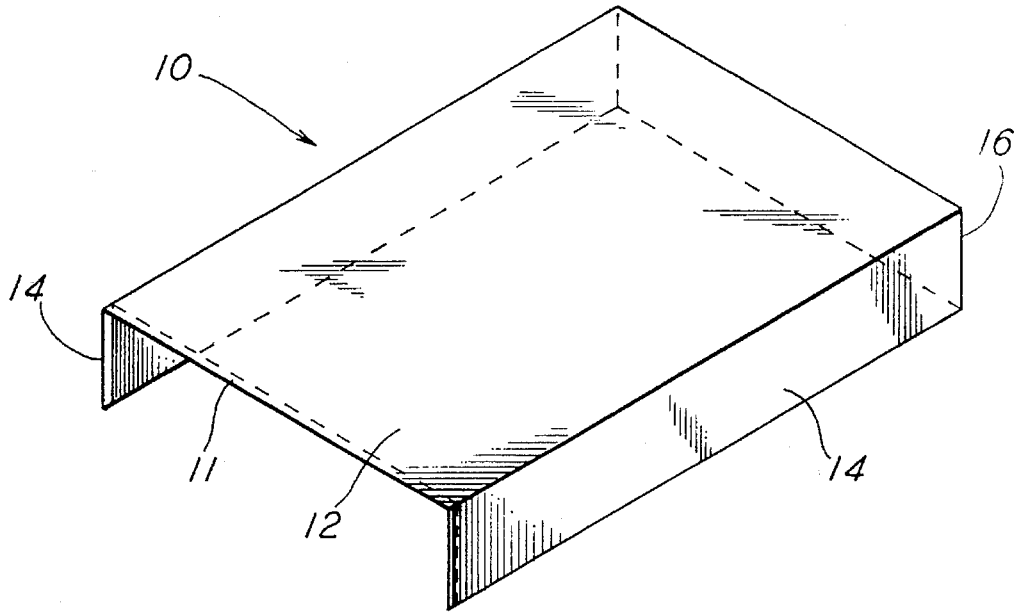
FIG. 1 is an isometric view of a partially fitted top bed sheet according to one embodiment of this invention with the sheet fully extended as viewed from the under surface of the sheet.

Prior to proceeding with a detailed description of the subject invention, it is noted that for the sake of clarity, identical components which have identical functions have been identified with identical reference numerals throughout the several views of the attached drawings.

Figure 2:
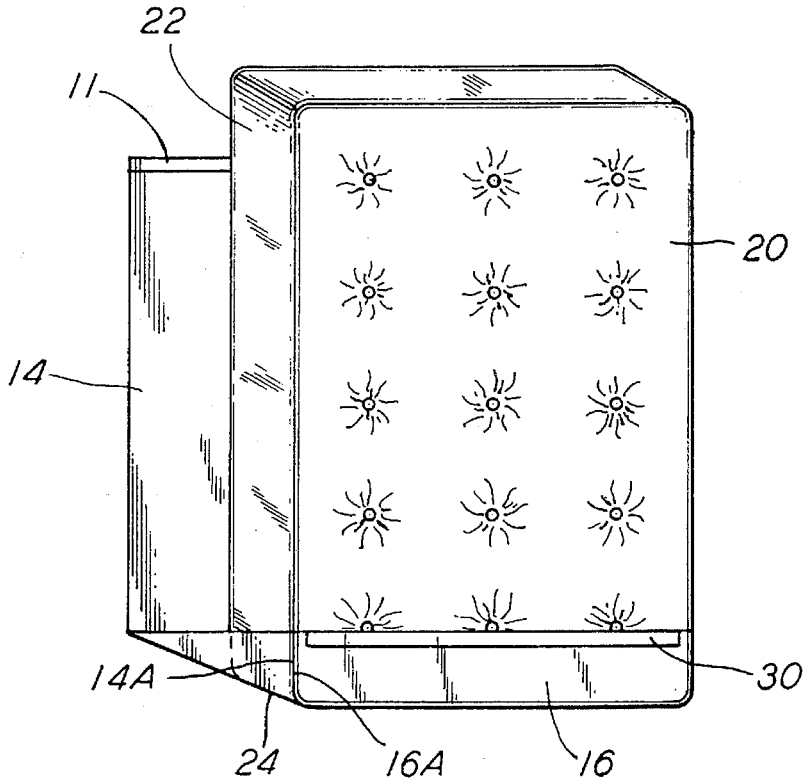
FIG. 2 is an underside view of a bed mattress having a sheet as illustrated in FIG. 1 fitted there with one side portion extended away from the mattress.

Reference to FIG. 1 will illustrate one embodiment of the unique partially fitted top bed sheet of this invention, which comprises a single piece of fabric, generally designated 10, having a rectangular top surface portion 12, the dimensions of which are adapted to fit flatly over a rectangular upper surface of a bed mattress 20 (FIG. 2). While ideally, the width of the rectangular top surface portion 12 should closely match the width of mattress 20, the length thereof, can be varied depending on one's preference, namely, depending upon where one would like the top edge 11 of the sheet 10 to be when the bed is made-up. As will be discussed subsequently, a small portion of the rectangular top surface portion 12 is intended to cover the bottom side surface surface 24 of mattress 20, so that this should be taken into account in determining the overall dimensions of rectangular top surface portion 12.

A pair of rectangular side portions 14, are provided which extend from opposite side edges of rectangular top surface portion 12, and are adapted to hang downwardly from rectangular top surface portion 12, and have a width ideally sufficient to overhang at least a major portion of the side surfaces 22 of bed mattress 20. In a like manner, a rectangular bottom portion 16 is also provided which extends from the bottom side edge of rectangular top surface portion 12, transversely between the lower ends of the pair of rectangular side portions 14. The width of rectangular bottom portion 16 is approximately the same as the width of the two side surface portions 14. Accordingly, the two side edges 16A of bottom portion 16 are joined, such as by sewing, to the adjacent side edges 14A of rectangular side portions 14 so that the partial "shoe-box lid" configuration is formed. Having such a configuration, top sheet 10 should be capable of being placed on the bed mattress 20 such that rectangular top surface portion 12 will overlay most if not all of the upper flat surface of bed mattress 20, with rectangular side portions 14 hanging downwardly covering most if no all of the two side surfaces 22 of bed mattress 20, and rectangular bottom portion 16 hanging downwardly in a like manner covering most if not all of the bottom surface 24 of bed mattress 20. Accordingly, the two rectangular side portions 14 and rectangular bottom portion 16 are capable of forming a continuous, three-sided skirt overhanging the side surfaces and bottom surface, 22 and 24 respectively, of mattress 20. While partially fitted bed sheet 10 should be capable of being fitted onto bed mattress 20, as described above and can be so fitted if desired, the above described fitting onto mattress 20 is intended only for purposes of clarifying the form, size and configuration of the inventive partially fitted, bed sheet 10, as the ideal use of top bed sheet 10, is not to be fitted onto mattress as above-described, but rather as will be described subsequently.

As a final element, at least one outstretched length of elastic material 30 is preferably secured along at least a portion of the length of rectangular bottom portion 16 extending transversely between the pair of side portions 14, to cause the ends 14A of rectangular side portions 14, adjacent to said bottom portion 16, to be drawn towards each other when the fitted bed sheet 10 is fitted onto mattress 20. Ideally, elastic material 30 is strip of any elastic material as may be purchased in any fabric shop having a width from a fraction of an inch to 2 inches which is preferably sewn to the outermost edge of bottom portion 16, over at least a portion of its length. Since the function to be served by the elastic material 30 is to cause the bottom ends 14A of side portions 14 to be drawn together, the elastic material 30 must be in an outstretched condition when attached; i.e., sewn, so that when released, such a drawing-together action will result. As should be obvious, to achieve the function desired, elastic material 30 can have practically any length desired, and can even be provided as a plurality of lengths, and the width is obviously not critical.

As noted above, partially fitted top sheet 10 should be capable of being placed on the bed mattress 20 such that rectangular top surface portion 12 will overlay most if not all of the upper flat surface of bed mattress 20, with rectangular side portions 14 and rectangular bottom portion 16 forming a continuous, three-sided skirt overhanging the side surfaces 22 and bottom surface 24 of mattress 20. While partially fitted bed sheet 10 should be capable of being fitted onto bed mattress 20, as described above and can be so fitted if desired, the ideal use of partially fitted top bed sheet 10, is not to be fitted onto mattress as above-described, but rather as described hereinafter. Specifically, the ideal method of applying top sheet 10 onto a bed mattress 20, is to fit the rectangular top surface portion 12 onto the upper flat surface of bed mattress 20, as above described. Then, top sheet 10 is pulled downward to an extend sufficient to permit the entire bottom portion 16 to be tucked under the bottom edge of bed mattress 20 so that an adjacent narrow band of rectangular top portion 12 is utilized to cover the bottom surface 24 of mattress 20. When this is done, top sheet 10 in not only held in place by virtue of the fact that a portion of it is tucked under mattress 20, but the exposed side portions 14, being joined to bottom portion 16 tucked under mattress 20, will naturally, not only hang downwardly to overlay and hide the side surfaces 22 of mattress 20, but will further form diagonally angled folds at the bottom end corner sides which are neat in appearance and will maintain the neat appearance, and yet will provided ample foot room, and easy access to and from the bed. The essence of this method of applying the partially fitted sheet is that "hospital corners" are preformed when the bottom portion 16 is tucked under mattress 20, and because the configuration of the top sheet is sewn-in, the preformed "hospital corners" are permanent, and can not be pulled out.

While the partially fitted top sheet 10 can be obviously made from any fabric material, it can rather easily be made from a conventional unfitted, flat sheet so that one can gain the advantage of having such a partially fitted top bed sheet which matches a fitted or conventional bottom sheet and thereby provide a matched set which includes such a partially fitted top bed sheet. To make such a partially fitted top bed sheet 10, one should start with a conventional flat bed sheet intended for use with a mattress size as desired. That is to say, to make a partially fitted top bed sheet 10 for a twin sized bed mattress 20, one should start with a flat bed sheet as sold for a twin sized bed mattress, and so on. Such a twin sized flat bed sheet is normally sold as having a rectangular configuration measuring 66 inches wide by 99 inches long. The ideal first step is to trim the width of the flat bed sheet to a width which equals the width of the mattress 20 plus approximately twice the thickness; i.e., the width of side surfaces 22. In this way, the resulting width of the finished fitted bed sheet 10 will be sufficient only to hang down to the extent necessary to cover the sides surfaces 22 of mattress 20, thereby avoiding any excessive and unsightly overhang, and accordingly eliminating the need to tuck-under such an overhang to improve the appearance. Obviously, if more or less overhang is desired for any reason, the width can be cut to any dimension as necessary to provide the degree of overhang desired. In order to gain the advantages described above in preventing excessive overhang that otherwise would need to be tucked under the mattress 20, however, the overhang should be at least the amount necessary to cover the side edges of mattress 20. In trimming the width of the bed sheet, of course, allowances should be made to hem under the cut edges to provide a finished edge. Since the techniques for finishing a raw cut edge are well known in the art, the details thereof need not be described here, suffice it to say that any of the well known techniques should be acceptable as necessary to provide the new finished width with neatly finished edges.

After the flat bed sheet has been trimmed to the width desired, it is normally preferred to trim the length to a more ideal dimension. The extent of such length trimming, will depend upon an individual's preferences based on where he or she would like the top edge of the sheet to be positioned when the bed is made-up. Accordingly, the length should be trimmed to a dimension that will provide desired length over the upper surface of mattress 20 plus enough length to cover the bottom edge surface 22 of mattress 20, plus an additional amount as necessary to make up the bottom portion 16 that will be tucked under the bottom edge of mattress 20 as described above. For most practical situations, it has been found that finished lengths of from 82 to 94 inches are ideal. As stated above regarding the width of the trimmed sheet, allowances should be made to permit the raw cut edge to be hemmed under pursuant to any accepted procedure. Accordingly, the starting flat bed sheet will normally be trimmed and finished to a size of about 50 to 54 inches wide to about 82 to 94 inches in length. Obviously, it makes no difference whether the width or length is the first dimension trimmed.

Figure 5:
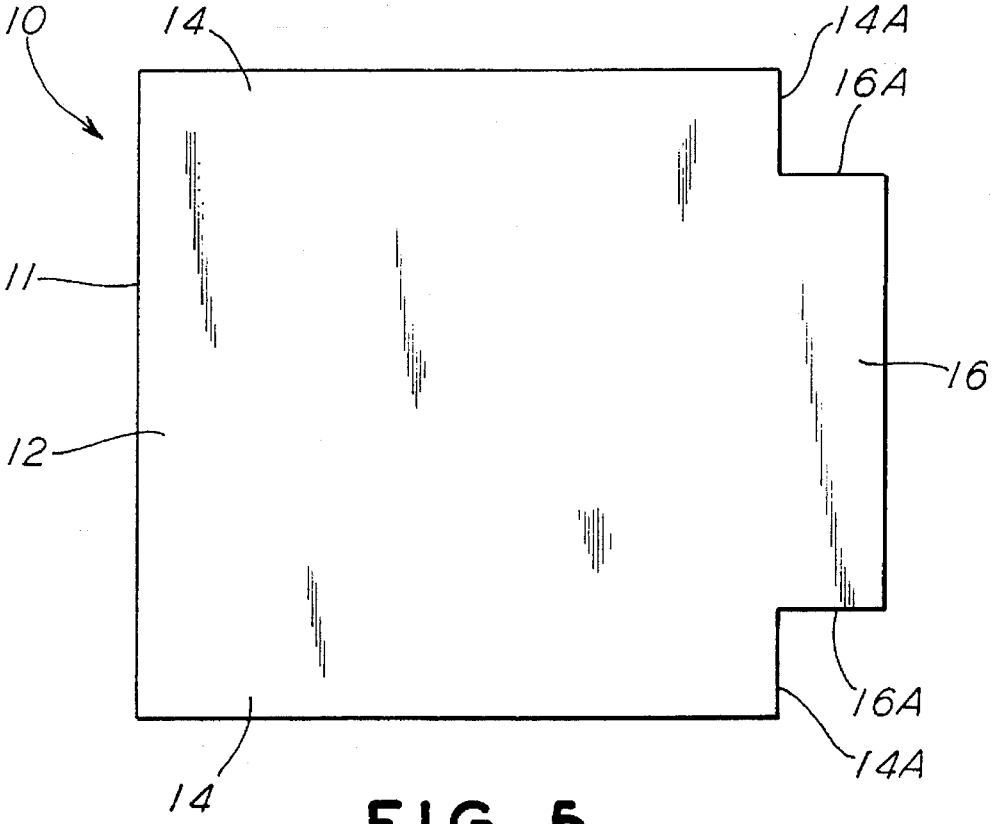
FIG. 5 is plan view of a conventional flat bed sheet after the corners have been cut away during the making of the partially fitted top bed sheet in accordance with the method taught herein.

After the flat bed sheet has been trimmed down in size as described above, one must determine which of the two adjacent corners are to be the bottom corners, and then a rectangular area cut out of each bottom corner as depicted in FIG. 5, with each side of the cut out corner being approximately equal to the thickness of bed mattress 20. Ideally, therefore, the rectangular cut-out portion is preferably square. While one may cut-out each corner individually, it may be more practical to fold the trimmed flat bed sheet lengthwise, with the side edges aligned and bottom corners aligned so that they can both be cut out at the same time.

After the rectangular or square corners are cut out as described above, the two cut edges at each corner are brought together and joined together, such as by sewing, so that two side portions 14 and bottom portion 16 form a continuous skirt capable of extending perpendicularly away from the remainder of the bed sheet. Again the techniques for sewing two such edges together are well known in the art and need not be detailed here, suffice it to say that any one of the well known techniques should be suitable. When the flat bed sheet is finished as above described, it will be capable of being shaped into the partial "shoe-box lid" configuration as described above.

While the above described method specifies that the bottom corners should be cut away first before the edges 16A and 18A are sewn together, it should be noted that in some commercial manufacturing facilities such sewing is often effected first before the excess fabric is cut away. For example, to effect such a corner, it would be common commercial practice to fold the fabric at the corner with the back side of the fabric exposed, so that a folded edge extends from the corner at 45 degrees to the abutting edges surfaces. Then the folded fabric is sown together along a straight line perpendicular to the abutting edge surfaces and spaced from the corner by a distance sufficient to provide desired depth. By thereafter cutting away the folded corner adjacent to the sewn line and exposing the outer surface of the fabric, the three-sided 90 degree corner is effected. Accordingly, for purposes of making a partially fitted top sheet 10, as described above, one may prefer to sew the corners first before cutting away the excess fabric.

As a last feature, a length of elastic material is preferably secured, such as by sewing, to the bottom portion 16 as necessary to cause the bottom ends of rectangular side portions 14 adjacent to such bottom portion 16 to be drawn towards each other when the bed sheet 10 is placed onto a mattress as described above. To effect this the preferred practice has been to place a mark on the outermost side of bottom portion 16 approximately 6 inches from the corner seam on each side. Then a length of elastic material 30, ideally one quarter inch wide, is sewn along the outer hem line of bottom portion 16 between the two marks. As previously noted, the elastic material 30 must be outstretched when attached so that it will draw the bottom ends of side portions 14 together under mattress 20 when fitted onto the mattress as above-described.

Figure 3:
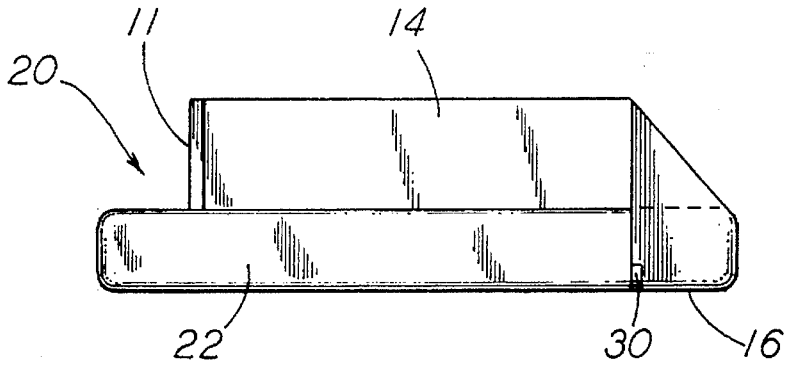
FIG. 3 is an elevational side view of the mattress and partially fitted top sheet shown in FIG. 2 as it would appear before the side portion is brought down to cover the side surface of the mattress.
Figure 4:
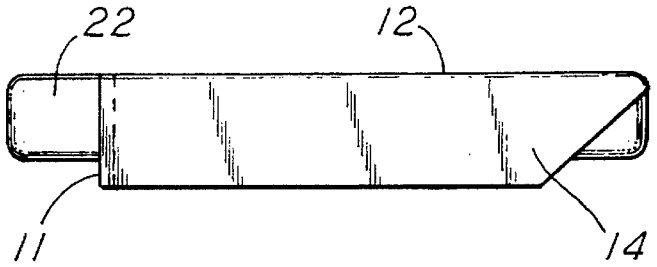
FIG. 4 is identical to the view shown in FIG. 3 except that the side surface has been allowed to hang down over the side surface of the mattress to complete bed make-up.

To aid in a better understanding of this invention, FIG. 2 illustrates a mattress 20 as viewed from underneath looking upwardly, with a partially fitted top bed sheet 10 placed thereon as above-described. As can be seen, bottom portion 16 is positioned to extend across the lower portion of mattress 20 where it would be tucked between mattress 20 and the box springs (not shown). Each of the side portions 14 would be capable of being lifted as depicted on one side in FIGS. 2 and 3, and also capable of hanging downwardly to cover the side edges of mattress 20 as shown in FIG. 4. As also shown in FIG. 4, the width of the shown side portion 14 is slightly more than necessary to overhang the full thickness of bed mattress 20. As noted above, however, the actual extent of such overhang is optional depending on preference.

While one embodiment of the invention has been illustrated, it should be apparent from the above discussion that a number of other embodiments and modifications could be utilized without departing from the spirit of the invention. As an obvious first example, it should be apparent that such a fitted top bed sheet could be made and applied to fit any sized bed mattress, including even a baby bed and a king size bed by only varying the dimensions as necessary to derive the desired results. As already noted in the specification above, certain dimensions can be varied to meet preferences and still retain the advantages as taught. As further suggested in the above specification, the partially fitted top sheet can be provided with or without the elastic material 30, depending on preference. Clearly, a number of other embodiments and modifications could be incorporated without departing from the spirit of the invention, for example, rather than sewing together edges 14A and 16A, one could provide snaps to snap the two edges together if desired for any reason.

I claim:

1. A method of making a partially fitted top sheet for a bed mattress having a predetermined thickness and a rectangular upper surface with a predetermined width and predetermined length, from a rectangular flat bed sheet, the steps comprising:

(a) cutting away at least one edge of said rectangular flat bed sheet and finishing the cut edge to form a rectangular flat bed sheet having a width approximately equal to the width of such bed mattress plus twice the thickness of such bed mattress;

(b) determining which of two adjacent corners will be further formed into bottom corners of said bed sheet;

(c) sewing each of said bottom corners of said rectangular bed sheet as necessary to provide a pair of rectangular side portions joined to a rectangular bottom portion to form a three-sided skirt capable of extending perpendicularly away from a remaining portion of said flat bed sheet, said three-sided skirt having a width approximately equal to the thickness of such bed mattress.

2. A method of making a partially fitted top sheet for a bed mattress according to claim 1 further including the step of joining at least one length of elastic material along at least a portion of the length of said bottom rectangular portion sufficient to cause said pair of rectangular side portions to be drawn together adjacent to said rectangular bottom portion.

3. A method of making a partially fitted top sheet for a bed mattress according to claim 1 in which at least one end of said flat bed sheet is first cut away and the cut edge finished to reduce the overall length of said bed sheet by approximately 12 to 14 inches.

4. A method of making a partially fitted top sheet for a bed mattress according to claim 1 in which said flat bed sheet is cut and finished in step (a) as necessary to reduce the width of said flat bed sheet by approximately 14 inches.

5. A method of making a partially fitted top sheet for a bed mattress from a rectangular flat bed sheet, the steps comprising:

(a) cutting away at least one of two edges of said flat bed sheet and hem under the cut edge to provide the bed sheet with a width approximately equal to the width of such bed mattress plus twice the thickness of said bed mattress;

(b) folding the trimmed rectangular flat bed sheet lengthwise to align the two edges and form two equal sized layers;

(c) determining which of two adjacent corners will be further cut to form bottom corners of said partially fitted bed sheet;

(d) cutting away a rectangular portion of said two layers from the aligned bottom corners, each of said square portions having a pair of edges approximately equal in length to the thickness of said bed mattress;

(e) joining said pair of cut edges together at each of said corners such that a pair of rectangular side portions joined to a rectangular bottom portion are formed on three sides of said bed sheet which are capable of extending perpendicularly away from a remaining portion of said flat bed sheet; and (f) joining at least one length of elastic material along at least a portion of the length of said bottom rectangular portion sufficient to cause said pair of rectangular side portions to be drawn together adjacent to said rectangular bottom portion.

6. A method of making a partially fitted top sheet for a bed mattress according to claim 5 in which said rectangular portion cut away in step (d) is square in shape.

7. A method of making a partially fitted top sheet for a bed mattress according to claim 5 in which said at least one length of elastic material is a single length of elastic material having a length at least equal to the predetermined width of said bed mattress and secured along an outside edge of said bottom portion by sewn stitching.

* * * * *